US006769589B2

(12) United States Patent
Paukov

(10) Patent No.: US 6,769,589 B2
(45) Date of Patent: Aug. 3, 2004

(54) CENTER-PULL SHEET MATERIAL DISPENSER

(75) Inventor: Ladislav Paukov, Delta (CA)

(73) Assignee: Englewood Ventures, Inc. (CA)

( * ) Notice: Subject to any disclaimer, the term of this patent is extended or adjusted under 35 U.S.C. 154(b) by 12 days.

(21) Appl. No.: 10/153,652

(22) Filed: May 24, 2002

(65) Prior Publication Data

US 2002/0139828 A1 Oct. 3, 2002

Related U.S. Application Data

(63) Continuation-in-part of application No. 09/709,372, filed on Nov. 13, 2000.

(51) Int. Cl.[7] ..... B26F 3/00; B26F 3/02; A47K 10/24; B65H 16/02

(52) U.S. Cl. ..... 225/106; 221/33; 221/44; 221/63; 221/304; 242/593

(58) Field of Search ..... 225/52, 106; 221/1, 221/303, 33, 44, 63, 34, 47, 304; 242/593, 615.2, 615.3

(56) References Cited

U.S. PATENT DOCUMENTS 4,524,895 A * 6/1985 Lunden ..... 225/106
4,905,868 A * 3/1990 Beane et al. ..... 221/44
5,131,903 A * 7/1992 Levine et al. ..... 225/106
5,141,171 A * 8/1992 Yang ..... 242/593
5,205,455 A * 4/1993 Moody ..... 225/106
5,211,308 A * 5/1993 Decker et al. ..... 221/63
5,215,211 A * 6/1993 Eberle ..... 221/1
5,246,137 A * 9/1993 Schutz et al. ..... 221/44
5,263,607 A * 11/1993 Temesvary et al. ..... 225/106
5,273,184 A * 12/1993 Rizzuto ..... 221/303
5,310,083 A * 5/1994 Rizzuto ..... 221/63
5,346,064 A * 9/1994 Rizzuto ..... 221/63
5,370,338 A * 12/1994 Lewis ..... 242/593
5,577,634 A * 11/1996 Morand ..... 221/33
5,715,971 A * 2/1998 Morand ..... 242/593
5,749,492 A * 5/1998 Petterson ..... 221/1
5,765,718 A * 6/1998 Grasso et al. ..... 221/63
5,857,642 A * 1/1999 Zinnbauer ..... 242/593
5,868,346 A * 2/1999 Cobos ..... 242/593
6,089,499 A * 7/2000 Robinson ..... 242/593
6,129,240 A * 10/2000 Morand ..... 221/63
6,145,782 A * 11/2000 King et al. ..... 242/593
6,328,252 B1 * 12/2001 Neveu et al. ..... 242/593
6,510,964 B2 * 1/2003 Paukov et al. ..... 221/33
6,575,397 B1 * 6/2003 Tramontina et al. ..... 242/593
6,592,001 B2 * 7/2003 Lewis et al. ..... 221/33
6,629,667 B2 * 10/2003 Tramontina ..... 242/593

* cited by examiner

*Primary Examiner*—Allan N. Shoap
*Assistant Examiner*—Jason Prone
(74) *Attorney, Agent, or Firm*—Hall, Myers, Vande Sande & Pequignot

(57) ABSTRACT

The invention consists of a paper towel dispenser for dispensing individual sheets of paper towels from a roll of paper having regularly spaced apart lines of partial severance. The dispenser is comprised of a housing and a housing door which can be pivotally opened to allow a roll of sheet material to be inserted into the dispenser. The dispenser has a funnel-shaped exit to allow the end of the roll to protrude in order to be grasped by the user. A paper towel tearing member is located adjacent to the funnel outlet of said funnel and the opening of this member is adjustable in order to vary the size of the opening of the dispenser. This adjustment of the exit size creates an adjustment in the position at which the sheet tears away from the roll to allow the use of different types of sheet material in a single dispenser.

8 Claims, 6 Drawing Sheets

CENTER-PULL SHEET MATERIAL DISPENSER

This application is a continuation-in-part of U.S. patent application Ser. No. 09/709,372 filed Nov. 13, 2000.

FIELD OF THE INVENTION

This invention relates to a dispenser for sheet material, particularly to a dispenser that dispenses individual sheets of a material, such as paper towels, from the center of a coreless roll divided into a plurality of sheets by partially severed spaced apart lines.

BACKGROUND OF THE INVENTION

A number of dispensers exist in the prior art for dispensing paper towels and similar sheet materials. One method of dispensing involves a "center-pull" mechanism whereby the sheet material is removed from the center of a coreless roll. The sheet material is pulled through a restricted opening that frictionally resists the pulling motion from the user. This resistance results in the sheet material tearing away into individual sheets at predetermined points marked by partially severed lines.

The most common design of center-pull dispenser uses a cone or funnel shaped nozzle to provide the opening for resisting and dispensing the sheet material. This design provides a large initial entrance for the end of the sheet material roll that allows for easy insertion of the end of a new roll, while also having the restricted exit opening necessary to provide sufficient resistance to allow tearing of the perforations.

There are a couple of problems with the current center-pull dispenser designs. First, some dispensers have the point of the opening formed by the casing which is of a relatively inexpensive plastic. The repeated passage of the sheet material against the exit opening wears down this plastic, eventually making the opening too large to provide proper resistance for tearing the perforations. In most cases, the entire unit must be replaced to resolve this problem.

A second problem is the need for multiple dispensers for different types of sheet materials. Different grades of sheet material require exit openings of different sizes and shapes. Ideally, a sheet material dispenser should be adjustable to allow dispensing of different grades of sheet material.

U.S. Pat. No. 5,749,492 discloses a center pull type of sheet dispenser which uses a funnel shaped plate having a central opening and a gap to allow passing the tail of a roll of paper towels through an exit aperture at the bottom. In one embodiment the cover or door closes to form the exit aperture through which the tail of the roll of paper hangs. However there is a significant risk of the sides of the funnel that abut one another closing on the paper. In yet another embodiment, two box end elements overlap below the exit aperture to define the exit aperture. With the particular design of one box end element over another, it is difficult to set the exit aperture so that it tears the roll and leaves an appropriate tail. This is due to the fact that the tail passes alternately, a semicircular jaw on one side then one on another side. With this type of structure, either tearing occurs prematurely of not at all.

Therefore, it is an object of this invention to provide a sheet material dispenser that has a modified exit opening that eliminates wear caused by friction from the sheet material.

It is a further object of this invention to provide a sheet material dispenser with an exit opening that can be adjusted in shape or size to allow the dispensing of different grades of sheet material.

SUMMARY

The invention consists of a paper towel dispenser for dispensing individual sheets of paper towels from a roll of paper having regularly spaced apart lines of partial severance. The dispenser is comprised of a hollow housing for receiving the roll of sheet material and a housing door, which can be pivotally opened to allow a roll of sheet material to be inserted into the dispenser. Advantageously, a bottom of the hollow housing and the housing door each have opposed concave surfaces which together define an exit aperture when the door is closed against the housing.

A funnel-shaped region at the bottom of the hollow housing terminates at the funnel outlet and has an opening along one side to permit entry of an end region of the roll. A paper towel ring assembly is positioned adjacent to the funnel outlet and includes a wear-resistant ring that is made of two halves, one half is positioned in the concave surface of the housing door and another half in the concave surface of the hollow housing such that on closing the housing door against the hollow housing, the two halves abut to form a wear-resistant ring. The wear-resistant ring is positioned in the exit aperture and encircles the tail of said roll. A paper towel tearing member is moveable over the wear-resistant ring and is adjustable to vary the size of the exit aperture so as to adjust the position at which each sheet tears away from the roll. This allows the use of different types of sheets of material in a single dispenser.

Preferably the exit aperture is positioned between an axis of the hollow housing and the housing door so as to provide sufficient room for a user's hand between an end of the roll and a wall to which the dispenser is mounted.

The paper towel tearing member may have a concave contour.

A raised block having a convex contour may be mounted opposed to the concave surface of the paper towel tearing member and mate with the paper towel tearing member when the paper towel tearing member is adjusted to contact the raised block.

When the user pulls on the roll end, the material rubs along the paper towel tearing member and the friction creates enough resistance to allow separation of individual sheets of material along pre-determined perforations to begin. Further pulling causes a predetermined tail from the subsequent sheet to hang out at the bottom of the dispenser. The wear-resistant ring is extremely resistant to the wear caused by the repeated use of the dispenser.

The adjustment of the paper towel tearing member may be provided by a sliding plate composed of the same wear-resistant material as the ring.

Preferably, the wear-resistant ring is also removable, to allow replacement of the wear-resistant ring in order to adjust the shape of the exit aperture to accommodate different grades of sheet material.

BRIEF DESCRIPTION OF THE DRAWINGS

The invention itself both as to organization and method of operation, as well as additional objects and advantages thereof, will become readily apparent from the following detailed description when read in connection with the accompanying drawings.

DETAILED DESCRIPTION

Figure 1:
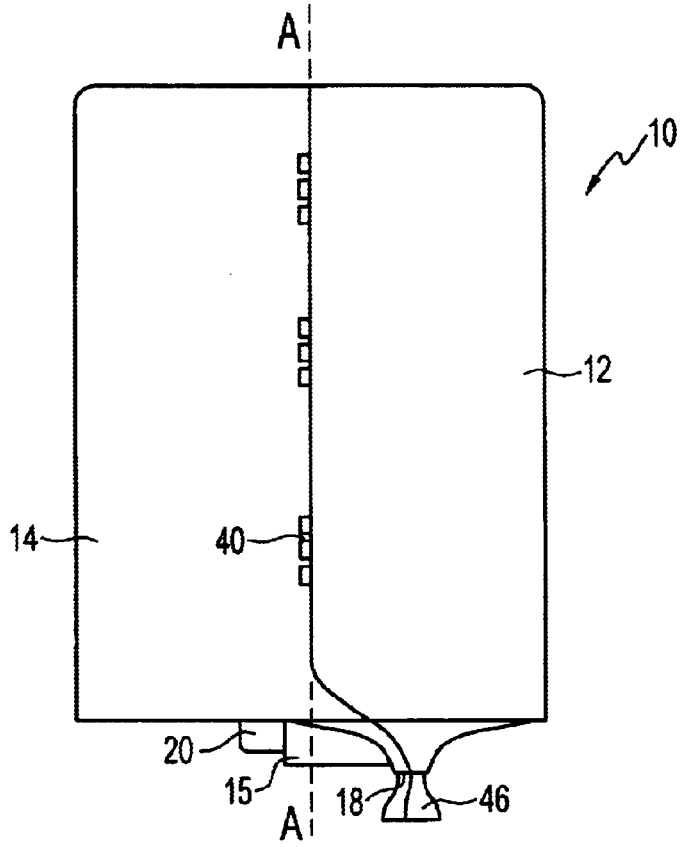
FIG. 1 is a side view of a closed dispenser.
Figure 2:
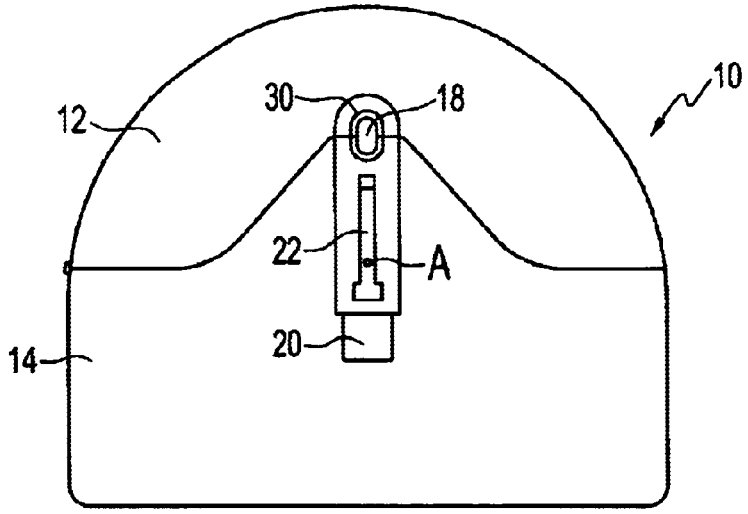
FIG. 2 is a bottom view of the base of a closed dispenser.

FIG. 1 shows the closed dispenser 10 for dispensing individual sheets from a roll of sheet material divided into a plurality of sheets by partially severed spaced apart lines. The dispenser 10 consists of a housing 14 and a housing door 12 pivotally attached to the housing 14. Any conventional method can be used to secure the housing 14 to a wall for use. For example, holes may be included in the back of the housing 14 to allow for screws to secure the housing 14 to a wall. Referring to FIG. 2, an exit aperture 18 is preferably located forwardly of a center axis A of the closed dispenser 10. By locating the exit aperture 18 forwardly of the center axis A, there is an increase in the space available to the user for grasping the projecting tail 46 when the dispenser is mounted on a wall. The exit aperture 18 is enclosed by a wear resistant split ring assembly 30.

Hinges 40, located on an exterior side of the dispenser 10, allow the housing door 12 of the dispenser 10 to be opened by rotating it away from the housing 14. A latch 13 (see FIG. 4) is used to hold the housing door 12 in the closed position. As seen in FIG. 1, a tail 46 of the sheet material projects through the exit aperture 18 to be grasped by a user.

Figure 3:
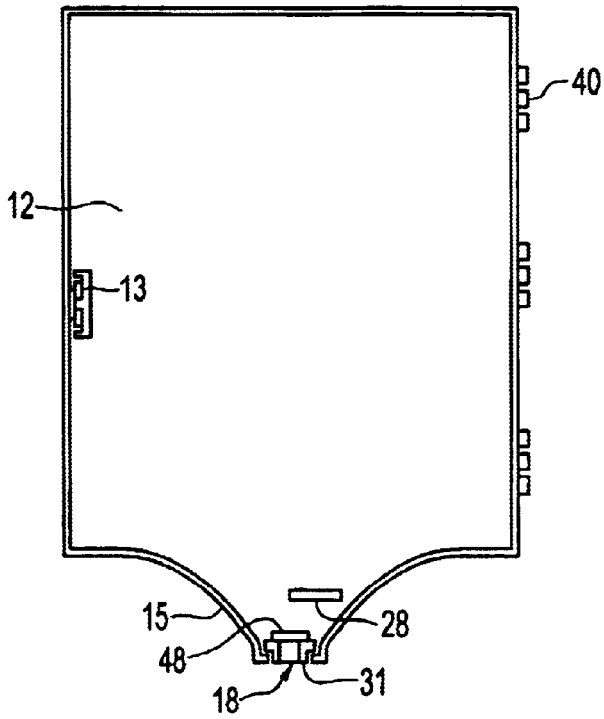
FIG. 3 is an interior view of the housing door.

FIG. 3 shows the interior of the housing door 12. A bumper 28 is near the bottom at a level of the funnel near the exit aperture 18. A housing mouth 15 is in the form of a tapered tube leading to an exit aperture 18. Installed in the exit aperture 18 is a door half-ring assembly 31.

Figure 5:
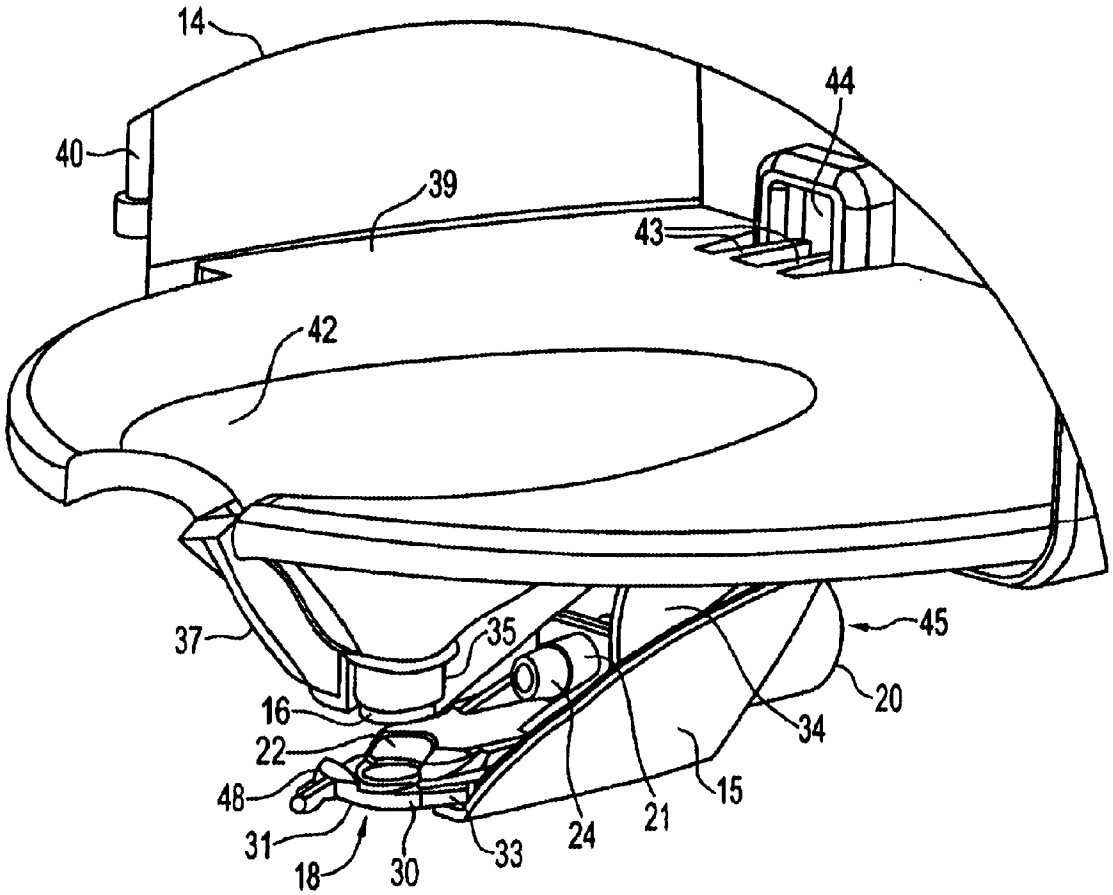
FIG. 5 is a perspective view of the funnel and ring assembly.

Referring to FIG. 5, a platform 39 is mounted in the bottom of housing 14 by means of a pair of flexible tongs 43 each with shoulders which extend through and engage opposite edges of slots 44. Funnel platform 39 holds a roll of paper sheets (not shown) and allows the roll to rotate as a tail 46 (see FIG. 1) is pulled by the user.

Figure 4:
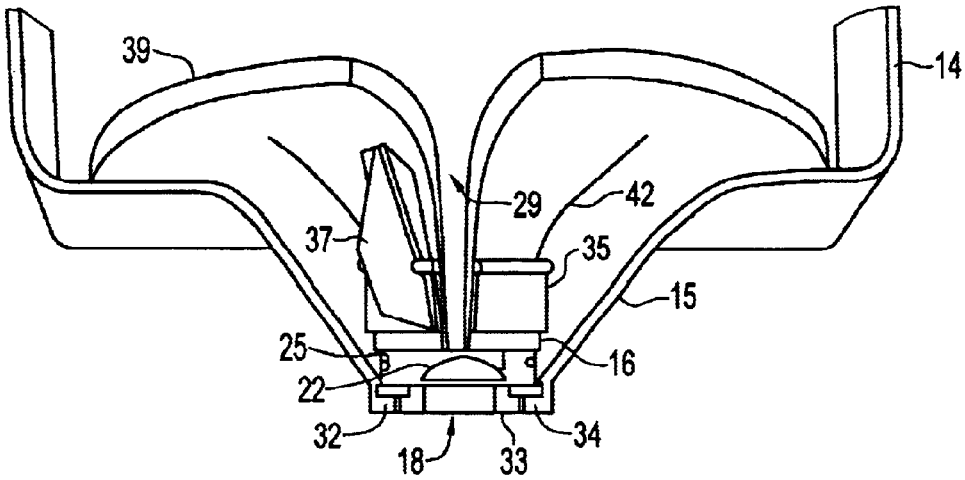
FIG. 4 is a front perspective view of a bottom part of the housing.

Referring to FIG. 4 the structure of the assembly at the exit aperture 18 is shown with the housing door 12 removed. The funnel platform 39 is interconnected by a funnel 42 to a funnel outlet 16. A gap 29 in the funnel 42 extends from the funnel platform 39 to the funnel outlet 16. A bottom portion of the funnel 42 is substantially cylindrical and is embraced by a cylindrical slit collar 35 having a collar gap blocker 37. The slit collar 35 is rotatable from a position in which the collar gap blocker 37 blocks gap 29 to a position in which a gap in the slit collar 35 is aligned with gap 29 by pulling on collar gap blocker 37 out and to the side. When aligned with gap 29, collar gap blocker 37 snaps into the gap 29 and becomes locked in place. When the collar gap blocker 37 is positioned away from and to a side of the gap 29, bumper (see FIG. 3) 28 contacts the collar gap blocker 37 and prevents housing door 12 from closing against housing 14. With the collar gap blocker 37 is locked in place in gap 29, housing door 12 is free to close against housing 14.

The funnel 42 is dimensioned to fit inside the housing mouth 15 and to allow space between the end of the housing mouth 15 and the exit opening 18 for a ring assembly 30. The funnel 42 also has a gap 29, which extends from the edge of the funnel platform 39 along the funnel 42 to the funnel outlet 16. Gap 29 allows for insertion of a new roll as described below.

Housing ring half 33 rests on projections 32 and 34 in the exit aperture 18. A tearing member 22 in the form of a sliding plate is mounted over the housing ring half 33. Preferably, the tearing member 22 has a rounded end to match the rounded shape of the exit opening 18. A raised block 48 (see FIG. 7) on the door ring half 31 has the opposite contour as the end of tearing member 22 and abuts the latter in mating contact when the tearing member 22 is moved forwardly to its maximum extension over exit aperture 18.

FIG. 5 shows more detail of the ring assembly 30 mounted in the exit aperture 18. In this case, door ring half 31 is shown abutting housing ring half 33 but ordinarily door ring half 31 is mounted in the exit aperture 18 of the cover as shown in FIG. 3. The housing ring half 33 has rails on either side which fit over projections 32 and 34 and are locked in place by a short lip at an end of housing mouth 15. A tearing member 22 has elongated ledges on either side which slide between protuberances 25 on housing 14 and a top surface of the rails of housing ring half 33. More detail is given in below in referring to FIG. 7.

Figure 6:
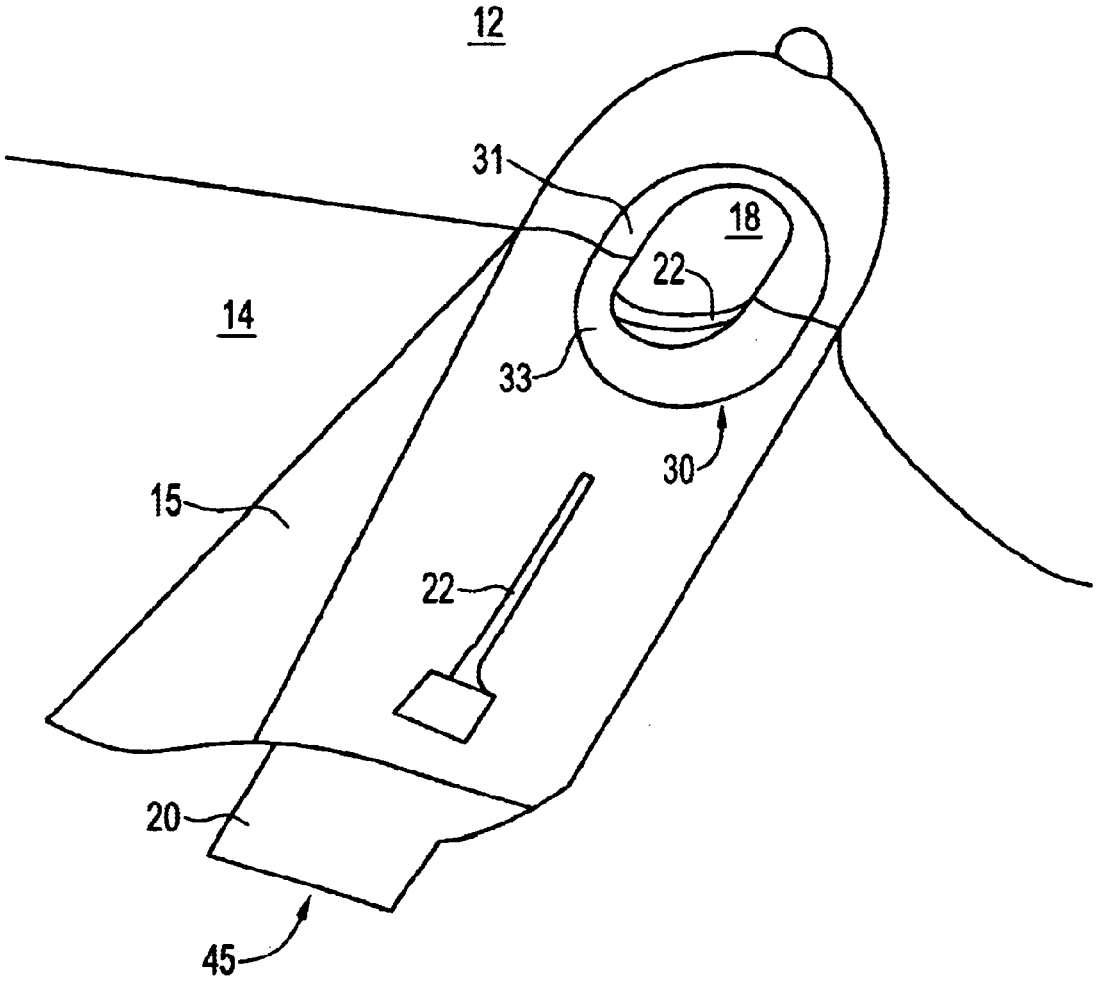
FIG. 6 is bottom view of the closed dispenser.

Referring to FIG. 6 the dispenser bottom surface is shown with the housing door 12 closed against the housing 14 so that door ring half 31 abuts housing ring half 33. A concave surface of the tearing member 22 is visible through the exit aperture 18. Cylindrical housing 20 encloses a head of a threaded bolt 24 (see FIG. 5) except at the end which exposes the head of the threaded bolt 45.

Figure 7:
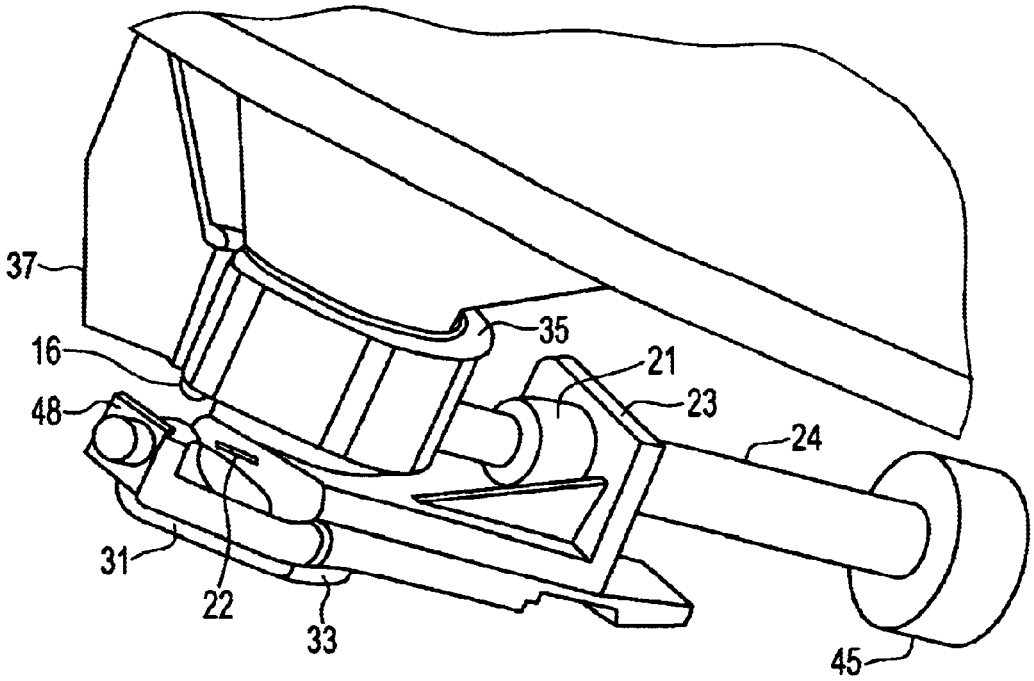
FIG. 7 is a perspective view of the ring assembly and split collar.

FIG. 7 shows in perspective the ring assembly 30 without the housing 14 in place and with the door ring half 31 abutting the housing ring half 33. The tearing member 22 has a bracket 23 with a threaded sleeve 21 that threadedly registers with the threaded bolt 24. A bolt head 45 provides the means of adjusting the position of the tearing member 22 relative to the housing 14 which encases a bolt head 45 and a portion of the bolt shaft. The bolt head 45 is rotatable within the housing 14. The position of the tearing member 22 is adjusted to reduce or enlarge the size of the exit aperture 18. The bolt head 45 is positioned such that it can be accessed from the exterior of the closed dispenser 10 (as shown in FIG. 1). The bolt head 45 has a unique screw head requiring a special key as an anti-tamper means to prevent user interference with the dispensing process.

Figure 8:
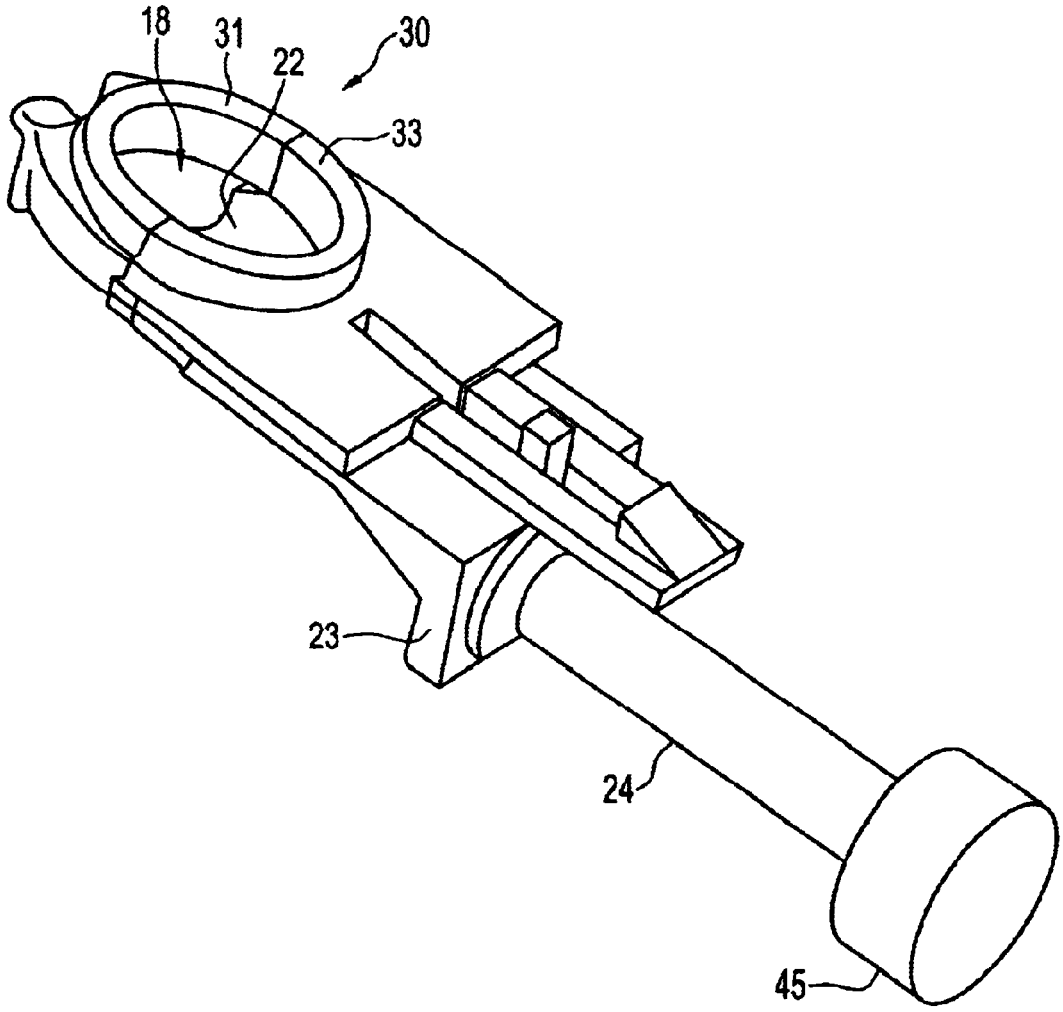
FIG. 8 is a perspective view of a bottom of the ring assembly.

FIG. 8 shows a bottom of the ring assembly 30 with the tearing member 22 visible through the exit aperture 18.

In operation, a roll of sheet material is mounted inside the dispenser 10. The tail 46 of the sheet material roll (see FIG. 1) is passed through the gap 29 and into the center of housing ring half 33. The user pulls the tail 46 of sheet material, which frictionally contacts the tearing member 22 above the ring assembly 30. The force exerted by a user, and the associated friction against the tearing member 22 increases until the roll of sheet material is partially severed along a line of perforation. Further pulling advances the sheet until the next tail extends out of the exit aperture 18 a predetermined distance, at which point the sheet material tears along the partially severed line. The tail 46 or torn end of the sheet material protrudes through the exit aperture 18, ready for use by another user.

Installing and replacing a roll of sheet material is facilitated by the housing construction. The housing door 12 is opened and pivoted to one side around the hinges 40. A roll of sheet material is then inserted into the housing 14. The end of the roll is passed through the gap 29 in funnel 42 and housing ring half 33 by the maintenance operator. The housing door 12 is then closed against the housing 14. The door ring half 31 then abuts the housing ring half 33 to encircle the tail 46.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the scope of the invention.

I claim:

1. A paper towel dispenser for dispensing individual sheets of paper towels from a roll of paper having regularly spaced apart lines of partial severance, between each pair of which is defined one of said individual sheets, comprising:

a) a hollow housing for receiving said roll, said hollow housing having a first concave surface;

b) a housing door pivotally attached to said hollow housing, said housing door having a second concave surface and reversibly moveable from a closed position in which said housing door is against said hollow housing to an open position such that an exit aperture is formed when said housing door is in said closed position;

c) a funnel-shaped region at the bottom of said hollow housing terminating in a funnel outlet and having a gap along one side to permit entry of a tail of said roll;

d) a paper towel ring assembly positioned adjacent to said funnel outlet, said paper towel ring assembly including a wear-resistant ring that is made of two halves, one half being positioned in said first concave surface of said hollow housing and another half in said second concave surface of said housing door such that when said housing door is in said closed position, said one half and said another half abut to form said wear-resistant ring, said wear-resistant ring positioned at said exit aperture and operative to encircle said tail of said roll; and e) a paper towel tearing member moveable over said wear-resistant ring and adjustable to vary the size of said exit aperture so as to adjust the position at which each sheet tears away from said roll.

2. A dispenser according to claim 1, wherein said exit aperture is positioned between an axis of said hollow housing and said housing door so as to provide sufficient room for a user's hand between an end of said roll and a wall to which said dispenser is mounted.

3. A dispenser according to claim 1, wherein said paper towel tearing member has a concave contour.

4. A dispenser according to claim 3, including a raised block having a convex surface opposed to the concave contour of said paper towel tearing member and mating with said paper towel tearing member when said paper towel tearing member is adjusted to contact said raised block.

5. A dispenser according to claim 1, including a collar gap blocker rotatably engaging a bottom of said funnel rotatable from an open position in which said gap is uncovered to a closed position in which said gap is covered wherein said housing door is blocked from closing when said collar gap blocker is in the uncovered position.

6. A dispenser according to claim 3, wherein said collar gap blocker is biased to snap into said gap when rotated to the covered position and must be flexed outwardly to exit from said gap.

7. A dispenser according to claim 1, wherein said roll of paper is mounted atop a funnel platform of said funnel-shaped region, from a front of said housing.

8. A dispenser according to claim 1, wherein said wear-resistant ring is removable.

* * * * *